US008660782B2

(12) United States Patent
Vang et al.

(10) Patent No.: US 8,660,782 B2
(45) Date of Patent: Feb. 25, 2014

(54) METHOD OF DISPLAYING TRAFFIC INFORMATION AND DISPLAYING TRAFFIC CAMERA VIEW FOR VEHICLE SYSTEMS

(75) Inventors: Doua Vang, Waterford, MI (US); Bilal Alasry, Dearborn, MI (US)

(73) Assignees: DENSO International America, Inc., Southfield, MI (US); Denso Corporation, Kariya-shi, Aichi-ken (JP)

( * ) Notice: Subject to any disclaimer, the term of this patent is extended or adjusted under 35 U.S.C. 154(b) by 463 days.

(21) Appl. No.: 12/975,770

(22) Filed: Dec. 22, 2010

(65) Prior Publication Data

US 2011/0246051 A1 Oct. 6, 2011

Related U.S. Application Data

(63) Continuation-in-part of application No. 12/751,880, filed on Mar. 31, 2010, now abandoned.

(51) Int. Cl.
*G08G 1/00* (2006.01)

(52) U.S. Cl.
USPC ..... 701/119; 701/117; 701/118; 701/120; 701/121; 340/937; 340/988; 180/171

(58) Field of Classification Search
USPC ..... 701/117–121, 2, 36; 340/907, 937, 936, 340/988, 989; 180/171
See application file for complete search history.

(56) References Cited

U.S. PATENT DOCUMENTS

| | | | | |
|---|---|---|---|---|
| 5,428,545 | A * | 6/1995 | Maegawa et al. | 701/423 |
| 2003/0210806 | A1 | 11/2003 | Yoichi et al. | |
| 2007/0118281 | A1 | 5/2007 | Adam et al. | |
| 2007/0225894 | A1 | 9/2007 | Tsukamoto | |
| 2007/0244627 | A1 * | 10/2007 | Boss et al. | 701/117 |
| 2009/0187300 | A1 * | 7/2009 | Everitt et al. | 701/29 |

FOREIGN PATENT DOCUMENTS

| | | |
|---|---|---|
| CN | 1928945 | 3/2007 |
| CN | 101046920 | 10/2007 |
| EP | 1357529 | 10/2003 |
| JP | 2002-283912 | 10/2002 |

OTHER PUBLICATIONS

Office Action dated May 2, 2013 in the corresponding CN application No. 201110085188.0 with English translation.

* cited by examiner

*Primary Examiner* — Thomas Tarcza
*Assistant Examiner* — Adam Tissot
(74) *Attorney, Agent, or Firm* — Harness, Dickey & Pierce, P.L.C.

(57) ABSTRACT

A method or a system for displaying a traffic camera view of a road on a display within a vehicle. The method or the system may include monitoring a movement of the vehicle, determining an existence of a traffic event based on the movement of the vehicle, receiving a traffic camera view on the road, and displaying the traffic camera view if the traffic event is detected.

19 Claims, 10 Drawing Sheets

FIG 7

| Driver No. | Road classification | Posted speed limit | Learned target value | Learned lower limit (m) | Learn Complete Flag |
|---|---|---|---|---|---|
| 001 | ACC2 | 50 | N/A | Learned lower limit (0) = 47<br>Learned lower limit (1) = 43<br>Learned lower limit (2) = 49 | 0 |
| 002 | ACC2 | 50 | 45.4 | Learned lower limit (0) = 46<br>Learned lower limit (1) = 43<br>Learned lower limit (2) = 45<br>Learned lower limit (3) = 44<br>Learned lower limit (4) = 49<br>Learned lower limit (5) = 33 | 1 |
| . | . | . | . | .<br>.<br>. | . |
| . | . | . | . | .<br>.<br>. | . |

FIG 8

| Road classification | Posted speed limit | target value |
|---|---|---|
| ACC3 | 45 | 45 |
| ACC2 | 50 | 50 |
| . | . | . |
| . | . | . |

METHOD OF DISPLAYING TRAFFIC INFORMATION AND DISPLAYING TRAFFIC CAMERA VIEW FOR VEHICLE SYSTEMS

CROSS-REFERENCE TO RELATED APPLICATIONS

This application is a continuation-in-part of U.S. patent application Ser. No. 12/751,880 filed on Mar. 31, 2010. The entire disclosure of the above application is incorporated herein by reference.

FIELD

The present disclosure relates to a method of displaying traffic information and displaying traffic camera views for vehicle systems.

BACKGROUND

This section provides background information related to the present disclosure which is not necessarily prior art. Modern vehicles may be equipped with a navigation system such as a built-in, factory installed navigation system or an aftermarket navigation system that is portable and may be easily installed and removed from an interior surface of a vehicle windshield. Such vehicle navigation systems may be capable of displaying real-time traffic camera feeds from roadways in front of or surrounding the vehicle. Selection of a specific camera feed may be made by selecting an icon from the navigation system display. While such navigation display traffic camera feeds have been satisfactory for their purposes, such systems are not without their share of limitations. One limitation relates to the number of icons that may be readable upon being displayed upon a navigation system display. More specifically, if a driver is driving in a densely populated urban area, such as a city, such city may have traffic camera feeds available for nearly every traffic light in the city. Selecting any given traffic camera feed from the navigation system display may mean selecting an icon on the navigation system display, which may be very crowded with not only traffic camera feed icons, but other icons such as "point of interest" icons, "building" icons, etc. What is needed then is a system or method for selectively displaying traffic camera feed icons on a navigation system display to avoid overcrowding the navigation system display with icons.

SUMMARY

This section provides a general summary of the disclosure, and is not a comprehensive disclosure of its full scope or all of its features. Method steps provided may be performed in the order presented or in an order deviating from that presented. A method of displaying a traffic camera view of a road on a display within a vehicle may include monitoring movement of the vehicle, determining existence of a traffic event based on the movement of the vehicle, receiving a traffic camera view of the road, and displaying, on the display, the traffic camera view if a traffic event is detected.

Moreover, the method of displaying a traffic camera view may include determining the existence of the traffic event based on a comparison between the movement of the vehicle and prerecorded drive data such as drive data stored in memory.

Still yet, the method of displaying a traffic camera view may include monitoring the vehicle, such as monitoring vehicle speed, as the movement of the vehicle. The prerecorded drive data may include corresponding prerecorded drive speed data for a road, and the method of displaying traffic may include determining the existence of a traffic event based on whether the vehicle speed is lower than the prerecorded drive speed data.

Still yet, the prerecorded drive data may include a corresponding posted speed for a road. The method of displaying a traffic camera view may include determining the existence of a traffic event based on whether the vehicle speed is less than the posted speed for a predetermined time period. The corresponding prerecorded speed for the road may be determined based on at least one of time and day. Moreover, the corresponding prerecorded speed for the road may be determined by road classification.

In another example, the movement of the vehicle may include a vehicle brake operation. The method of displaying traffic may include determining the existence of the traffic event based on whether the vehicle brake is applied for at least a predetermined time period.

Continuing, the method of displaying a traffic camera view may include determining if the vehicle is a predetermined distance from a traffic signal that the vehicle is approaching. The method of displaying a traffic camera view may further include waiting for a predetermined time if the vehicle is in the predetermined distance from a traffic signal that the vehicle is approaching, then determining again if the vehicle is in the predetermined distance from the traffic signal, and then determining whether a traffic event exists on a road upon which the vehicle is traveling.

Still yet, the method of displaying a traffic camera view may include a step for selecting that a traffic camera exists on the road ahead of the vehicle. In another example, the method also may include a step for selecting whether the traffic camera exists on a navigated route, which is provided by a navigation system. Moreover, the step for selecting may include selecting the traffic camera closest to a vehicle, or may include selecting a plurality of cameras.

Furthermore, the method of displaying a traffic camera view may include displaying the traffic camera view with a map indicating a position of the selected camera on the display.

A traffic camera view displaying system for a vehicle may include means for monitoring a movement of a vehicle, an electrical computing system for detecting an existence of a traffic event, means for receiving a traffic camera view which may be relevant to the traffic event, and a screen located in the vehicle and for displaying the traffic camera view. The electrical computing system may detect the existence of the traffic event based on movement of the vehicle, and the screen may display the traffic camera view when the electrical computing system detects the traffic event. Moreover, the electrical computing system may calculate a braking period of the vehicle based on the movement of the vehicle, and may detect the traffic event if the braking period is longer than a predetermined time period.

Still yet, the traffic camera view displaying system may further be equipped with a drive speed database that stores criterion speed data for a respective road classification. The electrical computing system may determine the classification of the road upon witch the vehicle is traveling, and calculate a speed of the vehicle based on the movement of the vehicle. Then, the electrical computing unit detects the existence of the traffic event if the speed of the vehicle speed is slower than the criterion speed data of the road classification. Additionally, a displaying system for a vehicle may have means for monitoring a movement of the vehicle, means for determining an existence of a traffic event based on the movement of the vehicle, means for receiving a traffic camera on the road, and means for displaying a camera view in accordance with the traffic cameras view as is disclosed in this disclosure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 7 is a table depicting a driver's speed behavior database;

FIG. 8 is a table depicting a factory default speed database;

Corresponding reference numerals indicate corresponding parts throughout the several views of the drawings.

DETAILED DESCRIPTION

Figure 1:
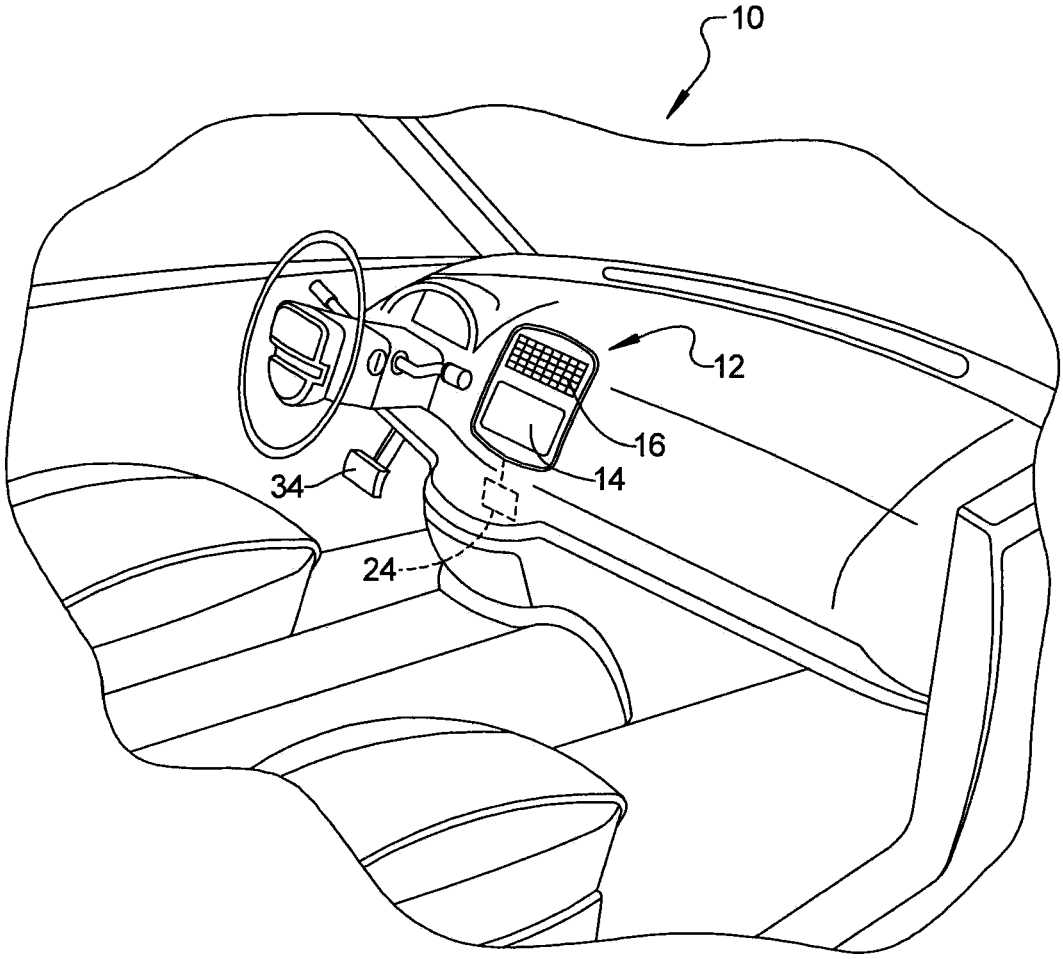
FIG. 1 is a perspective view of an interior of a vehicle depicting a location of a navigation system.

Example embodiments will now be described more fully with reference to FIGS. 1-12 of the accompanying drawings. FIG. 1 depicts an interior view of a vehicle 10 equipped with a factory installed navigation system 12; however, the present disclosure does not exclude an after-market navigation system that is portable and may be easily installed and removed from an interior surface of a vehicle windshield. Navigation system 12 may have a display 14 and buttons 16, which may be used to operate features of navigation system 12. Additionally, display 14 may be a touch-display and may be physically touched with a finger in order to operate a feature of navigation system 12. The touch-display feature of display 14 of navigation system 12 may work in conjunction with operating software of navigation system 12. The operating software of the navigation system 12 may be executed by an electrical computing system of the navigation system. Such electrical computing system may include an electrical computing unit attached to the vehicle and an external remote server. In this embodiment, the operating software is executed in the electrical computing unit in the vehicle, but in another embodiment, a part of or all of the operation may be operated outside of the vehicle.

Figure 2:
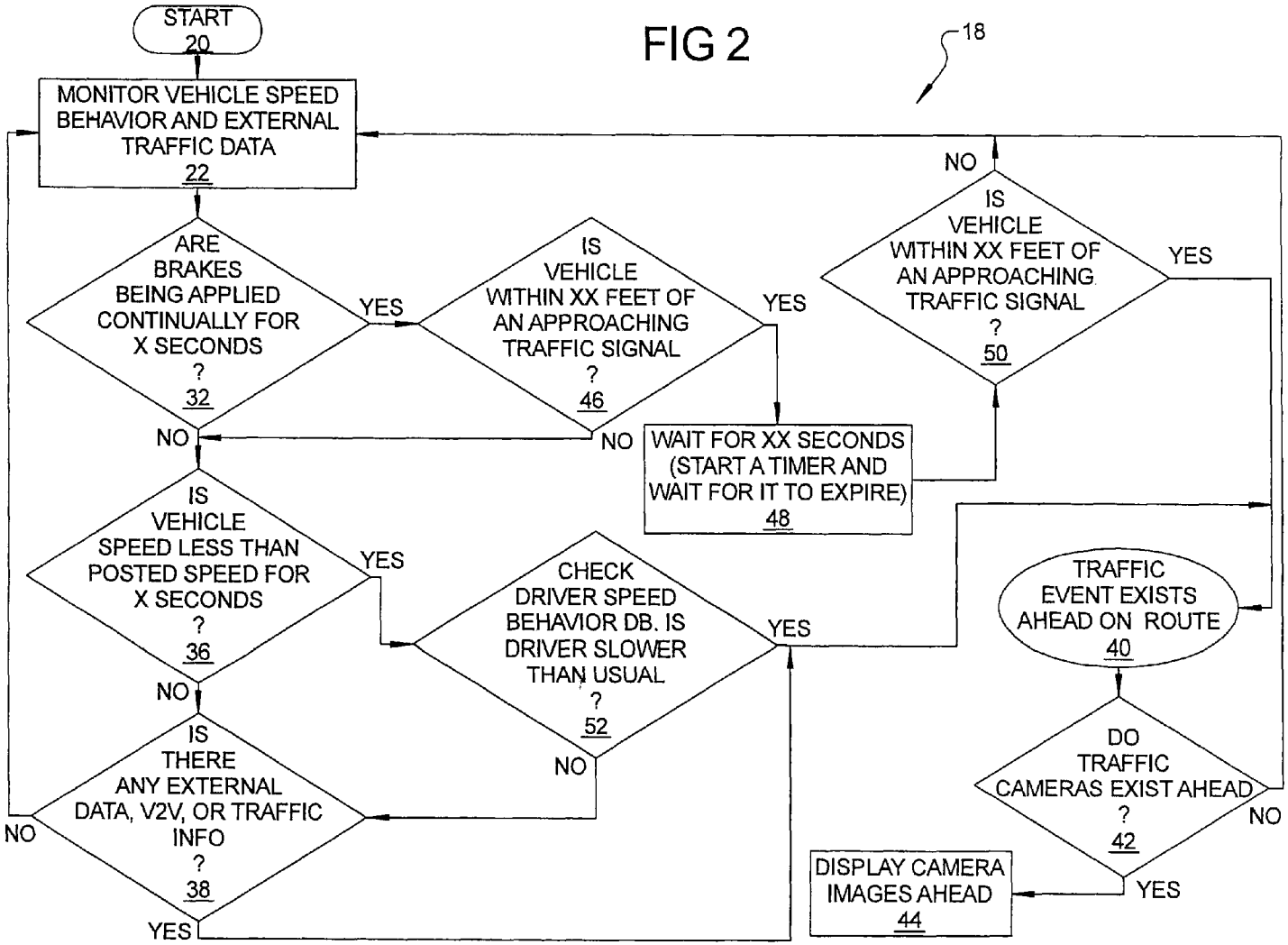
FIG. 2 is a flowchart depicting a method of controlling a vehicle navigation system in accordance with the present disclosure.

Turning to FIG. 2, flowchart 18 of operating logic of a method of controlling a navigation system such as navigation system 12 will be explained. Subsequent to start of logic at block 20, operating logic 18 proceeds to block 22 where a control module 24 of navigation system 12 may monitor vehicle speed and external traffic data via external servers, for instance. While the present disclosure will be explained using control module 24 which may be directly linked to, and be in communication with, navigation system 12, additional control modules dedicated to specific functions that may supply data to navigation system 12, or perform other functions, may be employed. Continuing with functions associated with block 22, a speed at which a driver of vehicle 10 is traveling may be monitored in conjunction with a type of road upon which vehicle 10 is travelling. For example, speed of vehicle 10 may be monitored by control module 24, which may be directly linked to a vehicle speedometer, engine control module that receives vehicle speed, a transmission control module that receives vehicle speed or other vehicle device that monitors vehicle speed, such as a portable navigation system having a GPS. Regarding categorization of roadways, companies that supply navigation system map data may categorize roads to assist a driver in selecting a roadway to travel and to inform a driver of what types of roadways are available. For instance, a four or six lane limited access highway may be categorized as road type "L1," a four lane road that is not limited access, such as in a business district with multiple business having access to the road, may be categorized as road type "L2," a two lane road (i.e. one lane in each direction) in a suburban area may be categorized as "L3," a residential street may be categorized as "L4," and a rural country road may be categorized as "L5."

In collecting traffic data or information, various methods or devices may be used. Sensors in a road may communicate traffic conditions based upon how often such sensors sense vehicles driving over such sensors. Sensing a number of vehicles per unit of time greater than a threshold number of vehicles may indicate a traffic event such as a traffic jam, while sensing a number of vehicles per unit of time less than a threshold number of vehicles may not indicate a traffic event such as a traffic jam. As another example, traffic data may be collected by "live field vehicles" which may be driven on prescribed roads to provide traffic reports of traffic conditions. Still yet, probe data from personal navigation devices ("PND") or cell phones may collect traffic data. Using such traffic data collection methods along with a GPS location will provide location and speed of one or more vehicles back to a central monitoring center, for example, from surrounding communication towers, which may initially receive such traffic data. Central monitoring centers are NavTEQ, TeleAtlas, INRIX, etc., may then broadcast the traffic data on a traffic messaging channel ("TMC") to end devices (vehicles) using services such as XM or HD radio as a method of transmitting. Such traffic data feeds may be in the form of FM frequencies to HD radio or as a satellite signal from XM, as examples.

Figure 3:
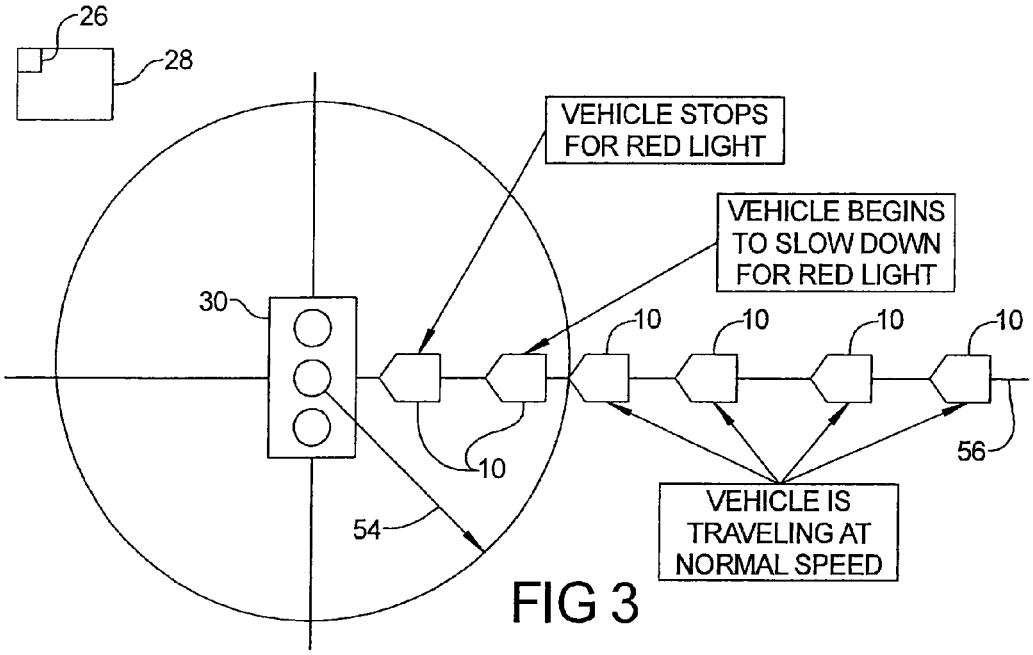
FIG. 3 is a diagram depicting a scenario of a vehicle slowing and stopping as it approaches a traffic signal.

Continuing with block 22 and with reference including FIG. 3, as control module 24, which may be a means for monitoring movement of the vehicle or means for monitoring operation of the vehicle, monitors vehicle movement or operation such as vehicle speed behavior of vehicle 10, external traffic data may also be monitored. More specifically, external traffic data may involve control module 24 receiving updates from traffic reports such as traffic data that is imported, downloaded at specific time intervals, or fed via a live information (e.g. video) feed into control module 24. Traffic data may be sourced from a server 26 maintained by a traffic data-collecting company located in an office building 28, for example that is acquired from real-time video camera feeds. Traffic information may be transmitted, wirelessly or with a wire, from a camera or traffic signal 30 (e.g. a traffic light) to server 26, which may then communicate the traffic information into control module 24 of vehicle 10 where it can be displayed on display 14 if so desired by a driver or vehicle occupant. Traffic information may be continuously updated while vehicle 10 is operating.

Continuing with FIG. 2, in this embodiment, control logic proceeds to decision block 32 where control module 24 continuously monitors a vehicle braking system, such as by monitoring vehicle brake pedal 34, to determine if brake pedal 34 is being applied or depressed for at least a predetermined amount of time, such as 4 seconds, for example (i.e. the vehicle movement or operation maybe continuously monitored); however, the predetermined time period may be any predetermined time period. If brake pedal 34 is not being depressed for at least a predetermined time period, then the logic proceeds to block 36 where the logic inquires if the vehicle speed is less than the posted speed for a predetermined time period, such as ten seconds. The posted speed may be stored as prerecorded drive data. In this embodiment, the posted speed is stored in a factory default speed database or driver's speed behavior database. The corresponding posted speed for the road may be determined based on time or day. The corresponding posted speed for the road may be determined by road classification (i.e. In this embodiment, the word "corresponding posted speed for the road" does not mean the posted speed in exactly the same road, it may mean the posted speed in same classification of road). If the response to the inquiry of block 36 is "NO," then the logic proceeds to block 38 to inquire if there is any external data, vehicle-to-vehicle communication data, or traffic information. If the inquiry block 38 is "NO," then the logic returns back to block 22 and begins again. However, if the response to the inquiry at block 38 is "YES," then the logic proceeds to block 40 where the logic determines that a traffic event exists ahead on the roadway upon which vehicle 10 is traveling. The logic, operated by the control module 24, which may be a means for receiving a traffic camera view which may be relevant to the traffic event, then proceeds to block 42 where the logic inquires whether traffic cameras exist forward of vehicle 10. If cameras do exist forward of vehicle 10 or near the roadway upon which vehicle 10 is traveling (i.e. the traffic camera exists on a navigated route, which is provided by a navigation system 12, or within a predetermined distance, such as 2 blocks, from the navigated route ahead of the vehicle, then the logic proceeds to block 44 where the control module 24, which may be a means for receiving a traffic camera view and means for displaying the traffic camera view, receives and displays the camera view onto display 14 of navigation system 12 within vehicle 10. In other words, the logic may include a step for selecting a traffic camera that exists on the road ahead of the vehicle 10. In another example, the logic also may include a step for selecting the traffic camera that exists on a navigated route, which is provided by a navigation system 12. Moreover, the logic may select the nearest traffic camera from the vehicle 10, or the logic may select a plurality of cameras. Furthermore, the logic may display the camera view with a map indicating a position of the selected camera on the display. However, if traffic cameras do not exist, then the logic returns to block 22, as explained above, and the proceeds to block 32. If the inquiry at block 32 is "YES," in which case brake pedal 34 is being applied continually for at least a predetermined time period, the logic proceeds to block 46 where the logic inquires if vehicle 10 is within a predetermined distance of an approaching traffic signal. If the result of the inquiry at block 46 is "NO," then the logic proceeds to inquiry block 36; however, if the result of inquiry block 46 is "YES," then the logic proceeds to block 48 where the logic will wait for a predetermined time period and then the logic will proceed to inquiry block 50 where the logic inquires if the vehicle is within a predetermined distance of an approaching traffic signal. If the inquiry at block 50 is "NO," then the logic proceeds back to block 22. However, if the inquiry at block 50 is "YES," then the logic proceeds to block 40 where the logic determines that a traffic event exists ahead on the roadway upon which vehicle 10 is traveling and then proceeds to inquire whether traffic cameras exist ahead at inquiry block 42. Again, if traffic cameras exist, the logic proceeds to block 44 where the navigation system 12 will display a traffic camera view ahead of vehicle 10. However, if no cameras exist ahead of vehicle 10, then the logic again returns to block 22.

Regarding inquiry block 36, if the result of the inquiry is "YES," then the logic proceeds to inquiry block 52 where the logic inquires if the driver is driving slower than usual. Checking whether or not driver is driving slower than usual may be done by control module 24, which may be a means for determining an existence of a traffic event, which checks the current driver and/or vehicle speed, and compares it to the driver's speed behavior database. The driver's speed behavior database may have prerecorded drive data (i.e. usual speed data used as a criterion speed data), which is obtained and recorded during the vehicle use. The corresponding driver's speed behavior for the road may be determined based on at least one of time and day. The corresponding driver's speed behavior for the road may be determined by road classification (i.e. In this embodiment, the word "corresponding driver's speed behavior for the road" does not mean the driver's speed behavior in exactly the same road, it may mean the driver's speed behavior on the same classification of road).

Determining an existence of a traffic event based on the movement of the vehicle may include predicting a traffic event based on an operation of the vehicle. Examples of a traffic event may include traffic (e.g. vehicles) that are stopped on a road or vehicles that are moving forward more slowly than a posted speed limit or other predetermined speed. Examples of an operation of a vehicle may include pressing a brake pedal.

Turning to FIG. 3, a scenario of vehicle 10 approaching a traffic signal is depicted. More specifically, FIG. 3 depicts vehicle 10 traveling at a normal or constant speed, such as a posted speed limit, when vehicle 10 is outside of a predetermined radius or distance 54 from traffic signal 30. FIG. 3 also depicts vehicle 10 moving within a predetermined radius or distance from traffic signal 30. At the point of moving within the predetermined radius or distance 54 from traffic signal 30, vehicle 10 may begin to move more slowly and decelerate, such for a yellow or red light displayed by traffic signal 30.

Figure 4:
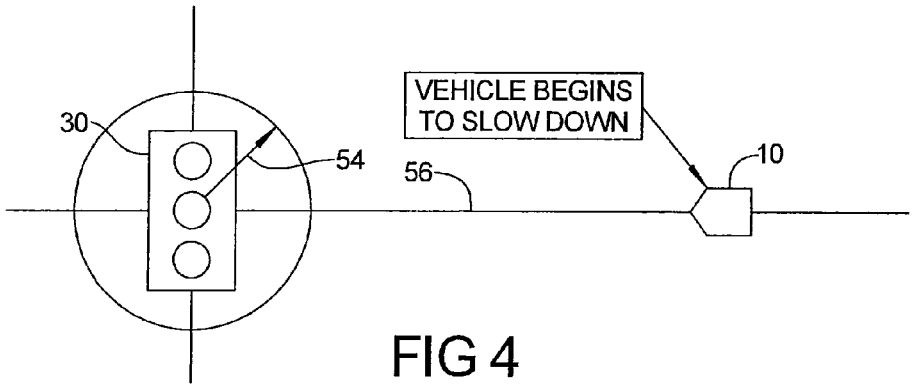
FIG. 4 is a diagram depicting a vehicle outside of a predetermined radius of a traffic signal.

FIG. 4 will be used to further explain a possible change in the scenario of FIG. 3 and depicts vehicle 10 not being within, but rather being outside of, predetermined distance 54 from traffic signal 30. However, even in the position depicted in FIG. 4, vehicle 10 may begin to decelerate and move more slowly. In such a situation, control module 24 may become aware of or become informed of a possible traffic condition by one or more specific "triggers" or an alert. Potential alerts may be vehicle speed or vehicle braking. This means that the traffic condition which exists ahead is not simply a result of the vehicle slowing down for a red light, for example, but a possible traffic incident may exist ahead on the roadway. The control module 24 will understand that the traffic condition that exists ahead is not the result of a traffic signal, such as depicted in FIG. 3, because vehicle 10 will be outside of predetermined distance 54 from traffic signal 30. Vehicle braking as a trigger may be braking time, which may be an interval of time that brake pedal 34 is depressed or applied.

Figure 5:
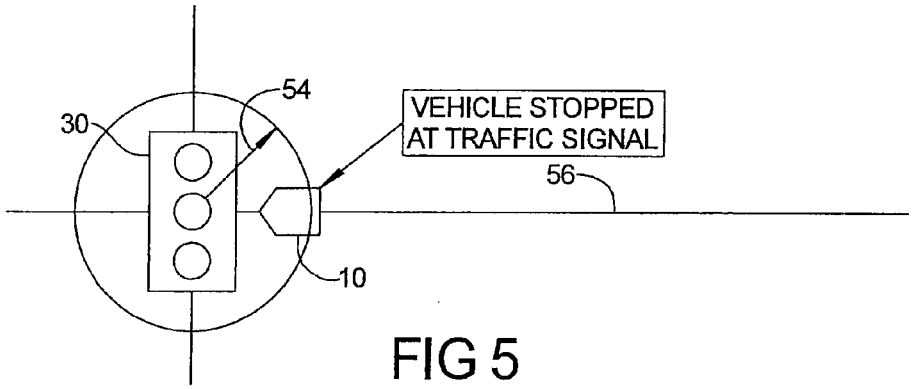
FIG. 5 is a diagram depicting a vehicle inside of a predetermined radius of a traffic signal.

FIG. 5 depicts a scenario in which vehicle 10 is inside a predetermined distance from traffic signal 30, and the logic was informed of a possible traffic condition by one of the triggers, such as vehicle speed or time that vehicle brake pedal 34 is depressed. In the scenario depicted in FIG. 5, it is not known if vehicle 10 is simply stopped for a red light at signal 30, or if some other traffic condition exists. Therefore, the logic monitors the time that vehicle 10 spends or remains inside an enclosed radius 54 from traffic signal 30. If vehicle 10 stays inside such area longer than a predetermined time period (e.g. 120 seconds or 2 minutes), it means that vehicle 10 is not simply waiting for traffic signal 30 to change from red to green, but rather a possible traffic incident may exist ahead on road 56 upon which vehicle 10 is traveling. It is assumed that traffic signals will change from red, meaning stop, to green, meaning go, within 120 seconds or less; however, such predetermined time period of 120 seconds may be changed to any predetermined time period upon which traffic signal 30 may operate.

Figure 6:
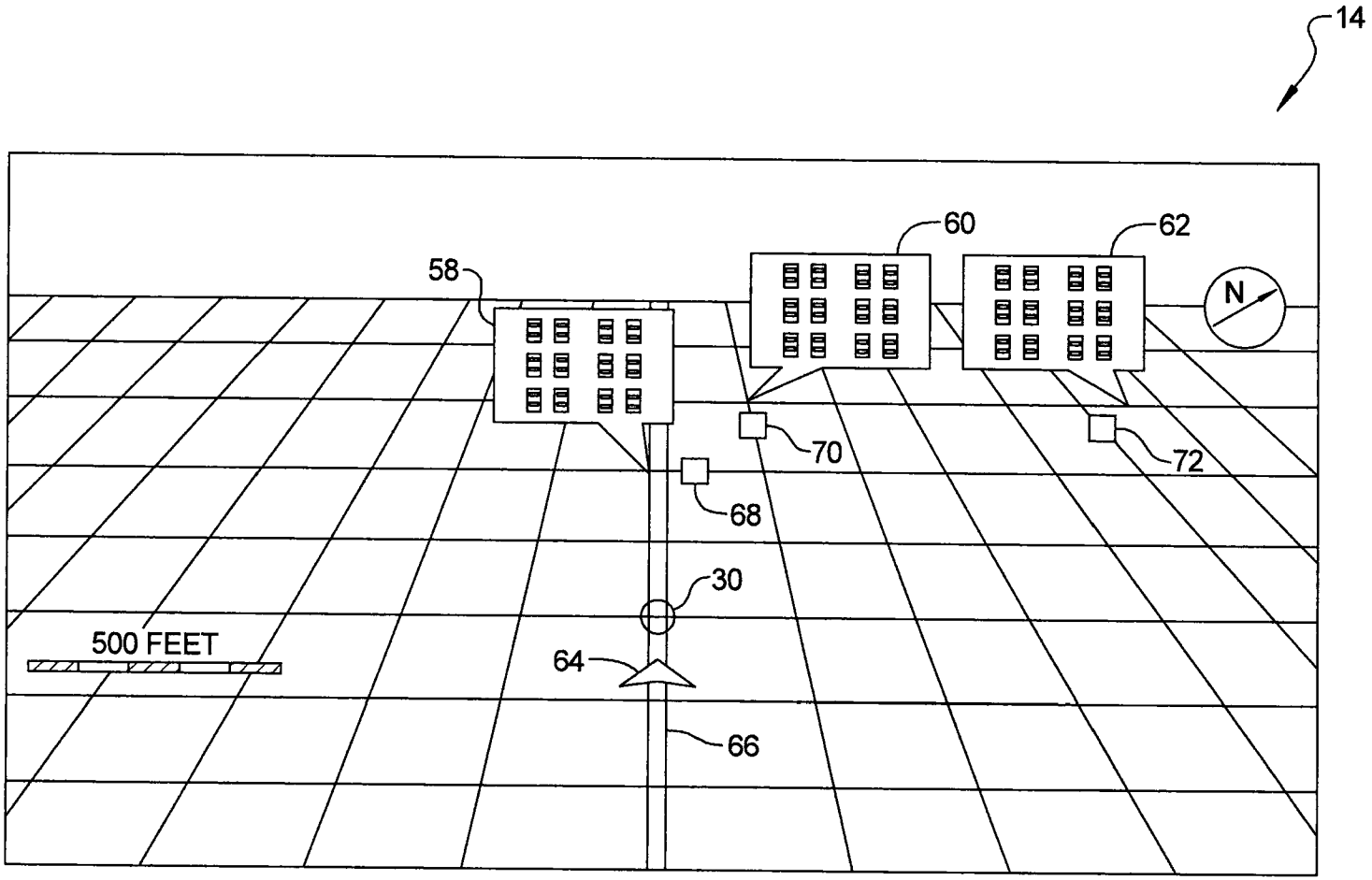
FIG. 6 is an example display screen shot depicting traffic events, buildings, a scale, etc.

FIG. 6 is an enlarged view of display 14, which may be a navigation system display, depicting various examples of traffic events 58, 60, 62 that may be considered external traffic data. Traffic events may involve a slowing or stopping of vehicles and may be caused by vehicle crashes, parades, concerts, sporting events, rain, snow or other climate event that may delay traffic below a posted speed limit for a given road. Thus, because of inquiries and corresponding results of method steps of flowchart 18 of FIG. 2, a driver in a vehicle at location 64 may view traffic events 58 on display 14 upon applying a brake 34 or by driving below a posted speed limit on road 66. Video of traffic event 58 may be supplied to display 14 by camera 68, which may be located within a viewing distance of traffic event 58. As further examples, camera 70 may depict traffic event 60 and camera 72 may depict traffic event 62 at different locations within a city, etc.

FIGS. 7 though 12 explain how to construct a driver's speed behavior database. FIG. 7 depicts the "Learned Value Table," which may be the driver's behavior database. This "Learned Value Table" may be stored in the vehicle or external server. The "Learned Value Table" includes a plurality of columns contains a plurality of parameters, such as "Driver number," "Road classification," "Learned target value," "Learned lower limit," and "Learn Complete Flag." With regard to the "Learned Value Table," data may be stored such that the first column contains at least one "Driver number," the second column contains at least one "road classification," the third column contains at least one "posted speed limit," the forth column contains at least one "Learned target value," the fifth column contains at least one "Learned lower limit," and the sixth column contains at least one "Learn Complete Flag." The driver number represents an individual driver. In this embodiment, recognition of the individual driver may be accomplished with one or more of a key fob code, driver weight, seat position, fingerprint, voiceprint, eye iris, vein certification, or driver face recognition.

Road classification, as explained above, may represent a road group, such as private road, municipal road, national high way, or interstate highway. In this embodiment, the Road classifications are Arterial Classification Codes. Arterial Classification Codes includes ACC1; North American continental inter-state wide high ways, ACC2; Inter-metropolitan area high ways, ACC3; Intra-state high ways, ACC4; City/County/Local roads and ACC5; Neighborhood streets. "Road classification" also may represent a certain specific road section. Moreover, other classifications may be used as "Road classification" instead of Arterial Classification Codes. In one embodiment, "I696W 1600 1900" represents "interstate highway 696 westbound at 16:00 to 19:00." With such certain specific road section classification, the system may avoid a pop-up traffic camera view in the usual frequent traffic jam points.

The "Learned target value" represents a calculated driver's usual speed on the road based on the Learned lower limit and a statistical bell-shaped curve. The Learned lower limit represents sampled driver's actual average speed on the respective road. The Learn Compete Flag represents a positive or negative response to whether the Learned target value has calculated for the corresponding road classification or not. In this embodiment, the default value of the Learn Complete Flag is "0."

FIG. 8 depicts the "Default factory value table," which is the factory default speed database, which may be pre-installed to the navigation system in the vehicle or stored in the external server. The first column contains "Road classification." The second column contains "Posted speed limit." The third column contains "target value."

Figure 9:
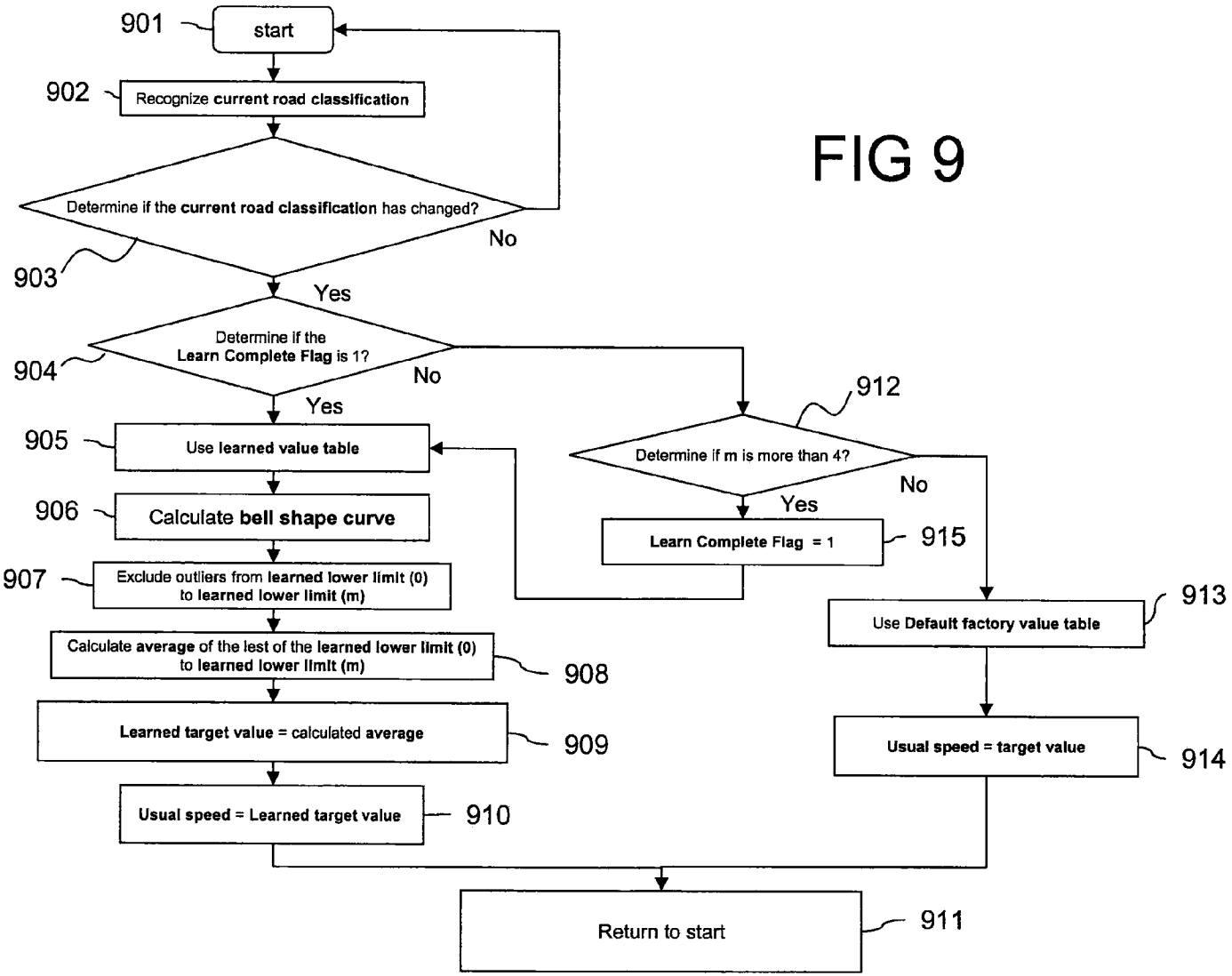
FIG. 9 is a flowchart depicting a method of selecting a database in accordance with the present disclosure.
Figure 10:
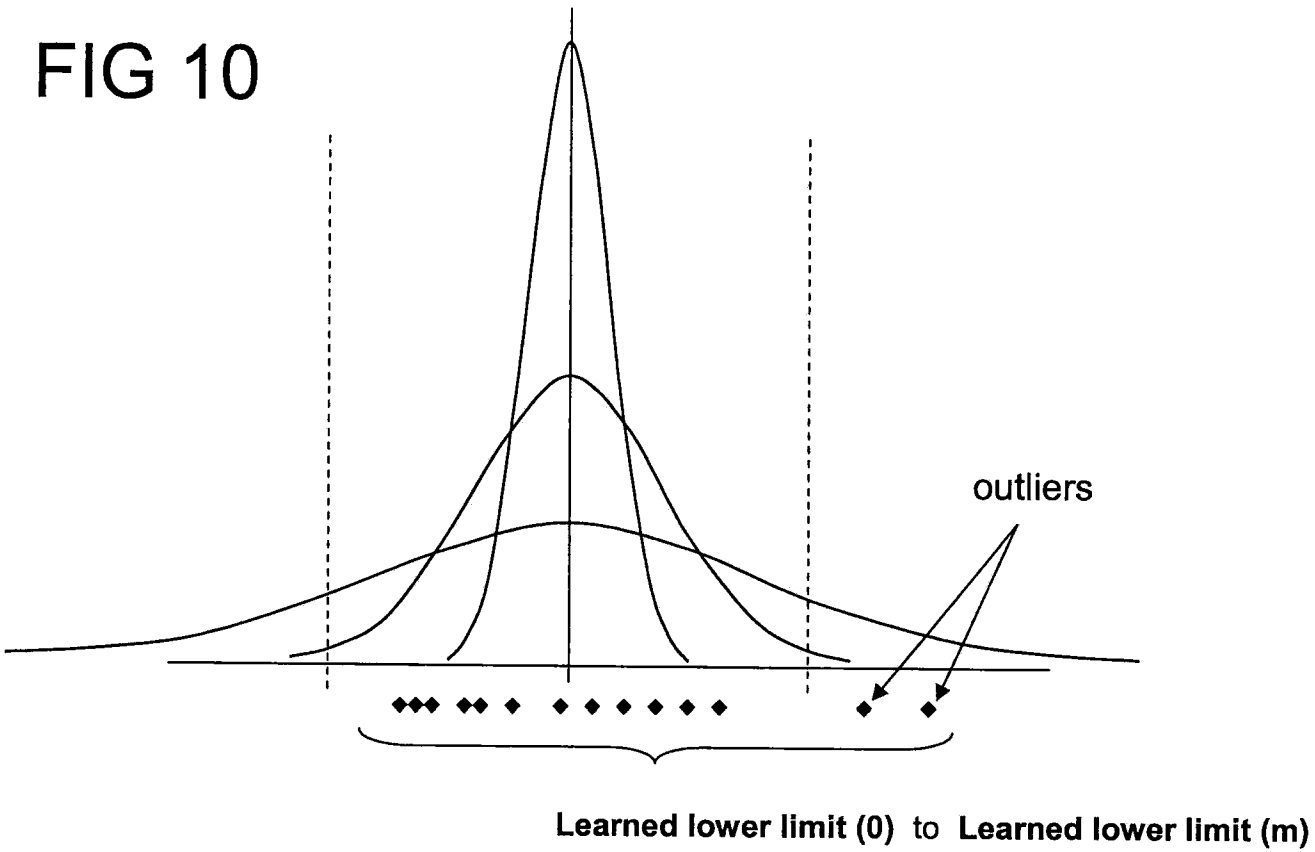
FIG. 10 is a graph depicting examples of bell-shaped curves used for excluding outliers from learned lower limits.

FIG. 9 depicts a flowchart for which database should be used for determining the driver's usual speed. It starts from block 901, and proceeds to recognizing current road classification in block 902. Recognition of the road classification is carried out based on at least the GPS device in the vehicle and map data stored in the navigation system or external server. Then in block 903, the method proceeds in determining if the current road classification has changed from the last time regarding road classification recognition, or not. If the current road classification has not changed, the method returns to block 901. If the current road classification has changed or if the ignition switch has just turned on, the method proceeds to block 904. Then, in block 904, the method continues with determining if the "Learn Complete Flag," which corresponds to the recognized road classification, is 1 (i.e. determining if the "Learned Complete Flag," which corresponds to the recognized road classification, has changed from the default value) or not. If the "Learn Complete Flag" is 1, the method proceeds to block 905. If the "Learn Complete Flag" is not 1, the method proceeds to block 912. In block 905, the method continues with loading "learned lower limits (0)" through "learned lower limits (m)" from the learned value table depicted in FIG. 7. A plurality of the "learned lower limit" may exist. The parameter "m" is used for identifying each "learned lower limit." The method then proceeds to block 906 where the method proceeds with calculating a bell-shaped curve based on the "learned lower limit (0)" to "learned lower limit (m)" for the corresponding road classification. Then, the method proceeds to block 907. In block 907, the method proceeds with defining outliers by using the calculated bell-shaped curve. Then, excluding the outliers from the "learned lower limit (0)" to "learned lower limit (m)" (examples of the bell-shaped curves are depicted in FIG. 10). The method proceeds to block 908 and performs calculating average value of the "learned lower limits (0)" through "learned lower limits (m)" without outliers. Then proceeds to block 909 where the method performs saving the calculated average value of the "learned lower limit (0)" to "learned lower limit (m)" as the "Learned target value" of the road classification. The method then proceeds to block 910 where the method uses the calculated "Learned target value" as a usual speed value of the driver in block 52 of FIG. 2, and then returns to block 901. In block 912, the method performs determining if the counter "m" is larger than a predetermined value "x," if the counter "m" is not larger than the "x," and proceeds to block 913. If the counter "m" is larger than "x," the method proceeds to block 915. In this embodiment, the "x" is 4. In block 913, the method performs loading the "target value" of the corresponding road classification from the "Default factory value table," and moves to block 914, the method uses the "target value" as a usual speed value of the driver in block 52 of FIG. 2, and then returns to block 901. In block 915, the method performs setting the "Learn Complete Flag"=1, and proceeds to block 905.

Figure 11:
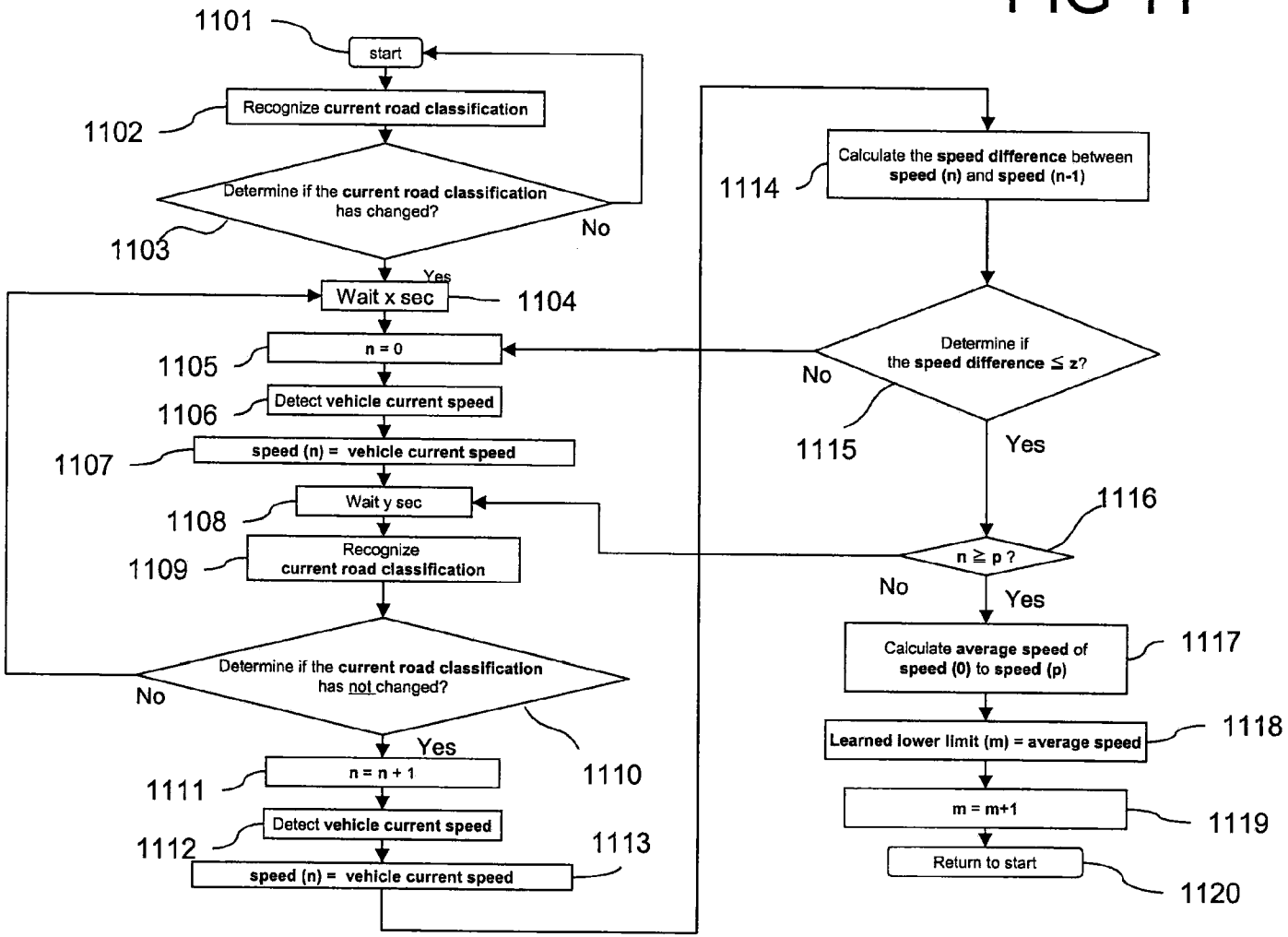
FIG. 11 is a flowchart depicting a method of learning a driver's behavior in accordance with the present disclosure.

FIG. 11 depicts a flowchart for how to store the "learned lower limits." Starting from block 1101, the method performs recognizing current road classification in block 1102. The same as the flowchart depicted in FIG. 9, the recognition of the road classification is curried out based on at least the GPS device in the vehicle and map data stored in the navigation system or external server. Then in block 1103, the method performs determining if the current road classification has changed from the last (i.e. previous) road classification recognition, or not. If the current road classification has not changed, go back to block 1101. If the current road classification has changed or if the ignition switch has just turned on, the method proceeds to block 1104. In block 1104, counting or waiting "y" seconds occurs. In this embodiment, "y" may be 10. After counting "y" seconds, the method proceeds to block 1105. In block 1105, the method sets a counter "n"=0, and proceeds to block 1106 where the method performs detecting vehicle current speed by vehicle speed sensors or the GPS devices. Then, the method proceeds to block 1107 where the method memorizes detected current speed as "speed (n)." The method proceeds to block 1108 when the method counts or waits "y" seconds again. After counting "y" seconds, the method proceeds to block 1109. In block 1109, the method recognizes current road classification. The same as in block 1102, the recognition of the road classification is carried out based on at least the GPS device in the vehicle and map data stored in the navigation system or external server. Then in block 1110, the method performs determining if the current road classification has not changed from the road classification recognized in block 1102. If the current road classification has not changed, the method proceeds to block 1111. If the current road classification has changed, the method proceeds to block 1104. In block 1111, incrementing "n" is performed. The logic then proceeds to block 1112 where detecting the vehicle current speed again occurs. In block 1113, the method stores in memory a detected current speed as "speed (n)." Then the method proceeds to block 1114. In block 1114, the method performs calculating the speed difference between "speed (n)" and "speed (n−1)." The method proceeds to block 1115, where determining if the speed difference is less than or equal to predetermined value "z" occurs. If the speed difference is less than or equal to the "z," the method proceeds to block 1116. If the speed difference is larger than the predetermined value "z," the method proceeds to block 1105. In this embodiment, the predetermined value "z" is 2. In block 1116, the method performs determining the counter "n" is larger than or equal to predetermined value "p." If the "n" is larger than or equal to the predetermined value "p," the method proceeds to block 1118. If the "n" is smaller than the predetermined value "p," the method proceeds to the block 1108. In this embodiment, predetermined value "p" is 5. In block 1117, the method calculates an average speed of speed (0) to speed (p). After proceeding block 1118, the method saves the calculated average speed as the "Learned lower limit (m)." The method proceeds to block 1119, where "m" is incremented. The method proceeds to block 1120 and returns to block 1101. The factory default value of the "m" is 0. In this embodiment, by recognizing the individual driver, drive behavior database may store learned lower limits separately for each driver. So, in this embodiment, the system can calculate a usual speed for an individual driver, and avoid an unnecessary traffic camera view from popping up.

Figure 12:
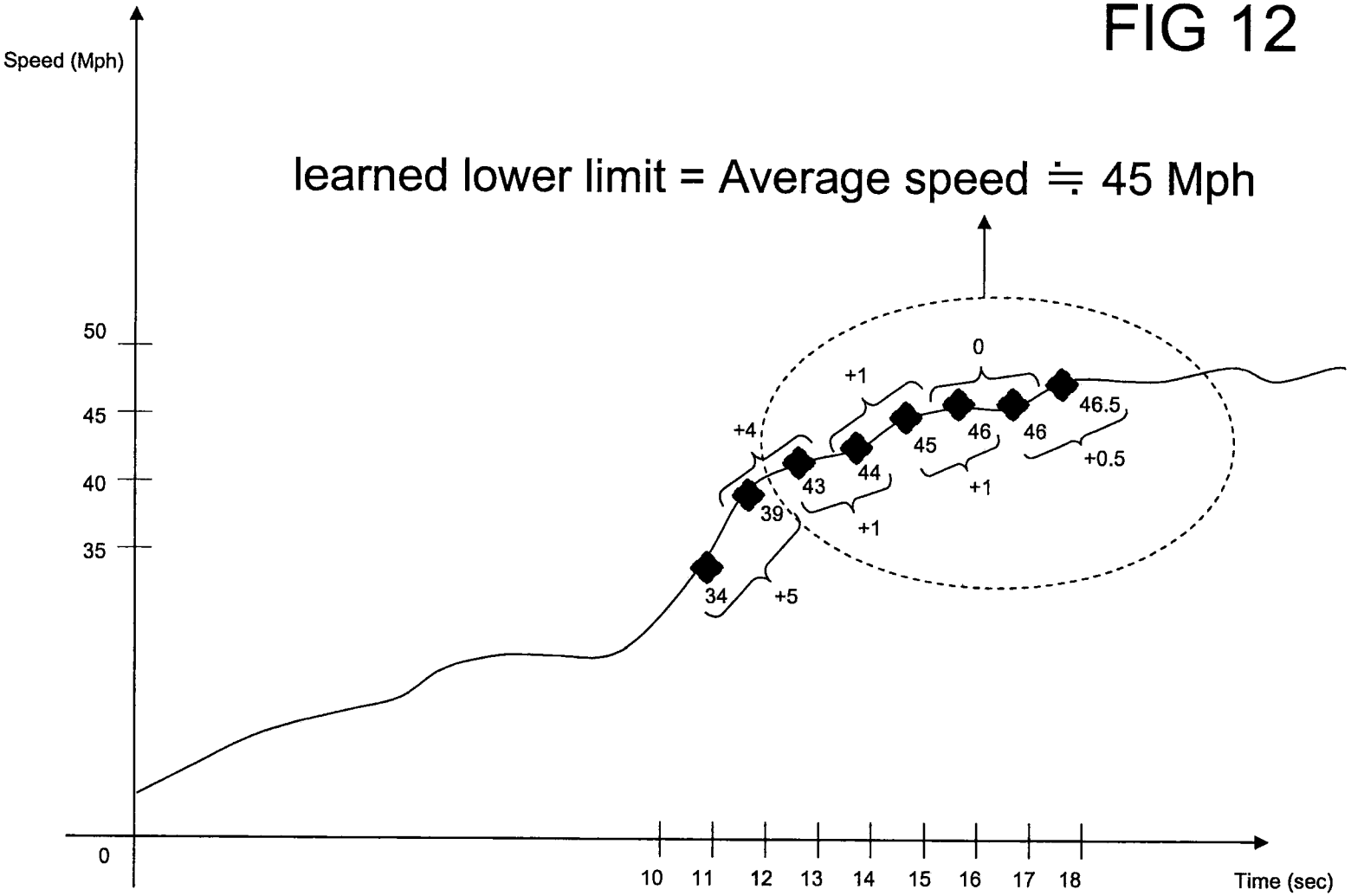
FIG. 12 is a graph depicting an example of sampling speeds and calculation of the learned lower limit using speed.

FIG. 12 is a graph depicting an example of how to calculate the "learned lower limit." The horizontal axis represents passed time that the vehicle has run into the new road classification. The vertical axis represents vehicle speed. The origin of this graph represents when the system recognizes the road classification change. As depicted in the example, the vehicle speed is gradually increasing within the first certain period. In this embodiment, the system starts sampling vehicle speed 10 seconds after the road classification change. And the system starts calculating the speed difference every second. If the speed difference settled within the 2 miles per hour for 5 seconds (there may be six instances of speed data), the system calculates average speed of the six speed data. In this embodiment, the six speed data are 43, 44, 45, 46, 46, 46.5, and the average speed is 45 miles per hour. The average speed is stored in the system as a "Learned lower limit (m)."

The foregoing description has been provided for purposes of illustration and description. It is not intended to be exhaustive or to limit the invention. Individual features of a particular embodiment and/or method are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. Moreover, the method steps, processes, and operations described herein are not to be construed as necessarily requiring their performance in the particular order discussed or illustrated, unless specifically identified as an order of performance. It is also to be understood that additional or alternative steps may be employed.

What is claimed is:

1. A method of displaying a traffic camera view of a road on a display within a vehicle, the method comprising:

sampling, by a control module, at least one actual speed of a driver on a road;

calculating, by the control module, a usual speed of the driver on the road based on the at least one actual speed;

determining, by the control module, an existence of a traffic event based on a comparison between a current vehicle speed on the road and the usual speed;

receiving, by the control module, a traffic camera view; and displaying, by the control module, the traffic camera view on the display if the traffic event exists; wherein the at least one actual speed includes a plurality of actual speeds, and the usual speed is calculated based on an average value of the plurality of actual speeds.

2. The method of displaying a traffic camera view according to claim 1, wherein:

the existence of the traffic event is determined if the current vehicle speed is lower than the usual speed.

3. The method of displaying a traffic camera view according to claim 1, wherein:

the existence of the traffic event is determined if the vehicle speed is less than the usual speed for a predetermined time period.

4. The method of displaying a traffic camera view according to claim 1, wherein the existence of the traffic event is determined if the vehicle brake operation is applied for a predetermined time period.

5. The method of displaying a traffic camera view according to claim 1, further comprising:

determining, by the control module, if the vehicle is within a predetermined distance from a traffic signal that the vehicle is approaching;

waiting for a predetermined time, if the vehicle is within the predetermined distance from the traffic signal;

determining again, by the control module, if the vehicle is within the predetermined distance from the traffic signal;

determining, by the control module, that a traffic event exists on a road upon which the vehicle is traveling, if the vehicle is still within the predetermined distance from the traffic signal.

6. The method of displaying a traffic camera view according to claim 1, further comprising:

selecting, by the control module, the traffic camera that exists on the road ahead of the vehicle and then displaying the selected camera view on the display if the traffic event exists.

7. The method of displaying a traffic camera view according to claim 1, further comprising:

selecting, by the control module, the traffic camera that exists on a navigated route, which is provided by a navigation system, or within a predetermined distance from the navigated route ahead of the vehicle, and then displaying the selected camera view on the display if the traffic event exists.

8. The method of displaying a traffic camera view according to claim 7, wherein selecting the traffic camera that exists on a navigated route further comprises selecting the traffic camera closest to the vehicle.

9. The method of displaying a traffic camera view according to claim 7, wherein selecting the traffic camera that exists on a navigated route further comprises selecting a plurality of cameras.

10. The method of displaying a traffic camera view according to claim 1, wherein displaying the traffic camera view on the display if the traffic event exists further comprises displaying the camera view with a map indicating a geographic position of the selected camera on the display.

11. The method of displaying a traffic camera view according to claim 1, further comprising:

calculating a bell-shaped curve based on the plurality of actual speeds;

excluding outliers of the plurality of actual speeds from the bell-shaped curve; and calculating the average value without the outliers.

12. A traffic camera view displaying system for a vehicle comprising:

means for sampling at least one actual speed of a driver on a road;

means for calculating a usual speed of the driver on the road based on the at least one actual speed;

an electrical computing system detecting an existence of a traffic event; and means for receiving a traffic camera view which is relevant to the traffic event, and a screen located in the vehicle that displays the traffic camera view, wherein, the electrical computing system detects the existence of the traffic event based on a comparison between a current vehicle speed on the road and the usual speed, the screen displays the traffic camera view when the electrical computing system detects the traffic event;

the at least one actual speed includes a plurality of actual speeds, and the usual speed is calculated based on an average value of the plurality of actual speeds.

13. The traffic camera view displaying system according to claim 12, further comprising:

means for monitoring a movement of the vehicle, wherein the electrical computing system calculates a braking time period of the vehicle based on the movement of the vehicle and detects the traffic event if the braking time period is longer than a predetermined time period.

14. The traffic camera view displaying system for a vehicle according to claim 12, further comprising:

means for calculating a bell-shaped curve based on the plurality of actual speeds;

means for excluding outliers of the plurality of actual speeds from the bell-shaped curve; and means for calculating the average value without the outliers.

15. A traffic camera view displaying system for a vehicle comprising:

means for sampling at least one actual speed of a driver on a road;

means for calculating a usual speed of the driver on the road based on the at least one actual speed;

means for determining an existence of a traffic event based on a comparison between a current vehicle speed on the road and the usual speed;

means for receiving at least one of a plurality of traffic camera views on the road; and means for displaying the traffic camera view if the traffic event is detected; wherein the at least one actual speed includes a plurality of actual speeds, and the usual speed is calculated based on an average value of the plurality of actual speeds.

16. The traffic camera view displaying system for a vehicle according to claim 15, further comprising:

means for calculating a bell-shaped curve based on the plurality of actual speeds;

means for excluding outliers of the plurality of actual speeds from the bell-shaped curve; and means for calculating the average value without the outliers.

17. A method of displaying traffic of a road on a display within a vehicle, the method comprising:

sampling, by a control module, at least one actual speed of a driver on a road;

calculating, by the control module, a usual speed of the driver on the road based on the at least one actual speed;

predicting, by the control module, an existence of a traffic event based on a comparison between a current vehicle speed on the road and the usual speed;

receiving, by the control module, a traffic camera view from a camera in front of the vehicle; and displaying, by the control module, the traffic camera view on the display; wherein the at least one actual speed includes a plurality of actual speeds, and the usual speed is calculated based on an average value of the plurality of actual speeds.

18. The method of displaying traffic of a road on a display within a vehicle according to claim 17, further comprising:

calculating a bell-shaped curve based on the plurality of actual speeds;

excluding outliers of the plurality of actual speeds from the bell-shaped curve; and calculating the average value without the outliers.

19. A method of displaying a traffic camera view of a road on a display within a vehicle, the method comprising:

monitoring, by a control module, a movement of the vehicle;

determining, by the control module, an existence of a traffic event based on the movement of the vehicle;

receiving, by the control module, a traffic camera view;

displaying, by the control module, the traffic camera view on the display if the traffic event exists;

determining, by the control module, if the vehicle is within a predetermined distance from a traffic signal that the vehicle is approaching;

waiting for a predetermined time, if the vehicle is within the predetermined distance from the traffic signal;

determining again, by the control module, if the vehicle is within the predetermined distance from the traffic signal; and determining, by the control module, that a traffic event exists on a road upon which the vehicle is traveling, if the vehicle is still within the predetermined distance from the traffic signal.

* * * * *